US008439494B2

(12) United States Patent
Owaki et al.

(10) Patent No.: US 8,439,494 B2
(45) Date of Patent: May 14, 2013

(54) LIQUID EJECTING HEAD, METHOD FOR MAKING THE SAME, AND LIQUID EJECTING APPARATUS

(75) Inventors: Hiroshige Owaki, Okaya (JP); Motonori Okumura, Shiojiri (JP); Munehide Kanaya, Azumino (JP); Nagamitsu Takashima, Okaya (JP); Yasuto Kanai, Matsumoto (JP); Koichi Saito, Matsumoto (JP); Kazuyoshi Imai, Sakata (JP); Hiroyuki Kamikura, Shiojiri (JP)

(73) Assignee: Seiko Epson Corporation

( * ) Notice: Subject to any disclaimer, the term of this patent is extended or adjusted under 35 U.S.C. 154(b) by 648 days.

(21) Appl. No.: 12/263,092

(22) Filed: Oct. 31, 2008

(65) Prior Publication Data

US 2009/0122125 A1 May 14, 2009

(30) Foreign Application Priority Data

Nov. 2, 2007 (JP) ..... 2007-286681
Feb. 14, 2008 (JP) ..... 2008-033790

(51) Int. Cl.
*B41J 2/175* (2006.01)

(52) U.S. Cl.
USPC ..... 347/93; 347/84; 347/85

(58) Field of Classification Search ..... 347/84–87, 347/92–93
See application file for complete search history.

(56) References Cited

U.S. PATENT DOCUMENTS

| | | | | |
|---|---|---|---|---|
| 5,464,578 | A | 11/1995 | Salter et al. | |
| 5,688,460 | A | 11/1997 | Ruschke | |
| 5,699,095 | A | 12/1997 | Mitsuzawa | |
| 5,938,991 | A | 8/1999 | Pollock | |
| 6,019,465 | A * | 2/2000 | Shinada et al. | 347/93 |
| 6,033,610 | A | 3/2000 | Swanson et al. | |
| 6,086,195 | A | 7/2000 | Bohorquez | |
| 6,190,009 | B1 * | 2/2001 | Kitahara | 347/93 |
| 6,196,673 | B1 | 3/2001 | Takahashi | |
| 6,415,121 | B1 | 7/2002 | Suzuki et al. | |
| 6,457,821 | B1 * | 10/2002 | Liu et al. | 347/93 |
| 6,634,742 | B2 * | 10/2003 | Owaki et al. | 347/93 |
| 6,814,435 | B1 * | 11/2004 | Shimada et al. | 347/93 |

(Continued)

FOREIGN PATENT DOCUMENTS

| | | |
|---|---|---|
| JP | 59-135110 U | 9/1984 |
| JP | 02-038377 | 2/1990 |

(Continued)

OTHER PUBLICATIONS

U.S. Appl. No. 12/389,507, Jun. 2, 2010, Office Action.

(Continued)

*Primary Examiner* — Ellen Kim
(74) *Attorney, Agent, or Firm* — Workman Nydegger

(57) ABSTRACT

A liquid ejecting head includes a head main body capable of ejecting a liquid supplied from a liquid storage unit, and a supply member provided with a liquid supply passage for supplying the liquid from the liquid storage unit to the head main body. The supply member has a filter mounting member provided with the liquid supply passage, a supply body that supplies the filter mounting member with the liquid, and a filter provided between the filter mounting member and the supply body. The supply member is provided with an outer portion that fixes the filter mounting member, the supply body, and the filter and that is formed by integral molding.

12 Claims, 12 Drawing Sheets

U.S. PATENT DOCUMENTS

| | | | | |
|---|---|---|---|---|
| 6,958,183 | B2 | 10/2005 | Okamura et al. | |
| 7,029,617 | B2 | 4/2006 | Nishimuro et al. | |
| 7,153,459 | B2 | 12/2006 | Kitahara | |
| 7,775,652 | B2 | 8/2010 | Taira | |
| 7,862,759 | B2 | 1/2011 | Kamikura | |
| 7,878,638 | B2 * | 2/2011 | Akase et al. | 347/92 |
| 7,922,311 | B2 | 4/2011 | Chikamoto et al. | |
| 2003/0197767 | A1 | 10/2003 | Dudenhosefer et al. | |
| 2004/0179057 | A1 | 9/2004 | Yamada | |
| 2004/0183229 | A1 | 9/2004 | Kunzel et al. | |
| 2004/0257414 | A1 * | 12/2004 | Anderson et al. | 347/93 |
| 2006/0001718 | A1 | 1/2006 | Shimuzu | |
| 2009/0207222 | A1 | 8/2009 | Kamikura | |
| 2009/0212460 | A1 | 8/2009 | Kamikura | |
| 2009/0213199 | A1 | 8/2009 | Owaki et al. | |
| 2009/0225142 | A1 | 9/2009 | Kamikura | |
| 2010/0071211 | A1 | 3/2010 | Kobayashi et al. | |

FOREIGN PATENT DOCUMENTS

| | | | |
|---|---|---|---|
| JP | 11-277758 | A | 10/1999 |
| JP | 2000-141683 | A | 5/2000 |
| JP | 2000-158667 | A | 6/2000 |
| JP | 2000-211130 | | 8/2000 |
| JP | 2001-030297 | | 2/2001 |
| JP | 2001-239677 | | 9/2001 |
| JP | 2002-067312 | | 3/2002 |
| JP | 2002-067342 | | 3/2002 |
| JP | 2003-201114 | | 7/2003 |
| JP | 2006-240245 | | 9/2006 |
| JP | 2007-069434 | | 3/2007 |
| JP | 2007-136737 | A | 6/2007 |
| JP | 2007-136871 | | 6/2007 |
| JP | 2007-160821 | | 6/2007 |
| JP | 2007-160863 | | 6/2007 |
| JP | 2007-245464 | | 9/2007 |
| JP | 2007-283688 | A | 11/2007 |
| JP | 2008-018625 | | 1/2008 |

OTHER PUBLICATIONS

U.S. Appl. No. 12/389,493, filed Feb. 20, 2009, Owaki et al.
U.S. Appl. No. 12/389,507, Nov. 4, 2010, Notice of Allowance.
U.S. Appl. No. 12/561,932, Mar. 16, 2011, Notice of Allowance.
U.S. Appl. No. 12/389,493, Aug. 19, 2011, Office Action.
U.S. Appl. No. 12/398,349, Sep. 2, 2011, Office Action.

* cited by examiner

LIQUID EJECTING HEAD, METHOD FOR MAKING THE SAME, AND LIQUID EJECTING APPARATUS

CROSS REFERENCES TO RELATED APPLICATIONS

The present invention contains subject matter related to Japanese Patent Application No. 2007-286681 filed in the Japanese Patent Office on Nov. 2, 2007 and Japanese Patent Application No. 2008-033790 filed in the Japanese Patent Office on Feb. 14, 2008, the entire contents of which are incorporated herein by reference.

BACKGROUND OF THE INVENTION

1. Technical Field

The present invention relates to a liquid ejecting head capable of ejecting liquid, a method for making the same, and a liquid ejecting apparatus. More specifically, the present invention relates to an ink jet recording head capable of discharging a liquid ink, a method for making the same, and an ink jet recording apparatus.

2. Related Art

In an ink jet recording head, which is one example of a commonly used liquid ejecting head, ink is typically supplied from an ink cartridge which acts as a liquid storage unit, through a series of ink supply needles which are detachably inserted into the ink cartridge, through a series ink flow paths formed in a supply member such as a cartridge case which holds the ink cartridge, and finally into a head main body. Then, by driving pressure generating units such as piezoelectric elements provided in the head main body, the ink supplied to the head main body is discharged from nozzles.

In such an ink jet recording head, if air bubbles in the ink in the ink cartridge are supplied to a head main body, or if air bubbles are introduced to the ink when an ink cartridge is attached or detached and are consequently supplied to a head main body, the air bubbles may cause defects in the discharging process, and create printing errors, such as missing dots. To solve this problem, one or more filters for removing air bubbles and dust in ink are provided between ink supply needles inserted into an ink cartridge and the supply member. One example of an ink jet recording head with this configuration is shown in Japanese Patent No. JP-A-2000-211130.

The filter may be fixed to the supply member, for example, by thermal welding. The ink supply needles may be fixed to the supply member, for example, by ultrasonic welding.

However, in a configuration such as that described in Japanese Patent No. JP-A-2000-211130, the filters are provided in the area of the supply member where the supply needles are fixed. Therefore, it is necessary to provide sufficient area so that separately welding processes may be formed for both the ink supply needles and the filters. Therefore, the distance between adjacent ink supply needles cannot be reduced, meaning that the size of the recording head cannot be reduced.

In addition, in a configuration such as that described in Japanese Patent No. JP-A-2000-211130, if the size of the filters is excessively reduced in order to reduce the size of the recording head, the dynamic pressure increases, meaning that the amount of drive voltage generated by the driving pressure generating units such as piezoelectric elements or heater elements needs to be increased.

Such problems exist not only in ink jet recording heads but also in liquid ejecting heads that eject a liquid other than ink.

BRIEF SUMMARY OF THE INVENTION

An advantage of some aspects of the invention is to provide a liquid ejecting head, a method for making the same, and a liquid ejecting apparatus with a liquid ejecting head with a reduced size.

A first aspect of the invention is a liquid ejecting head comprising a head main body capable of ejecting a liquid supplied from a liquid storage unit, and a supply member forming a liquid supply passage for supplying the liquid from the liquid storage unit to the head main body, the supply member comprising a filter mounting member, a supply body that supplies the filter mounting member with the liquid, a filter provided between the filter mounting member and the supply body, and outer portion provided around a region of the filter which is formed by an integral molding process, wherein the outer portion fixes the filter mounting member, the supply body, and the filter in the supply member.

By fixing and integrating the filter mounting member, the filter, and the supply body using the outer portion, there is no need for a region for individually welding the supply body and the filter to the filter mounting member. Thus, the effective area of the filter can be increased, and the distance between adjacent supply bodies can be reduced. Therefore, the head can be reduced in size.

A second aspect of the invention is a liquid ejecting apparatus includes the above liquid ejecting head. A liquid ejecting apparatus reduced in size and cost can be achieved.

A third aspect of the invention is a method for making a liquid ejecting head including a head main body that ejects a liquid supplied from a liquid storage unit, and a supply member provided with a liquid supply passage for supplying the head main body with the liquid. The supply member has a filter mounting member, a supply body that supplies the liquid to the filter mounting member, and a filter provided between the filter mounting member and the supply body. The method includes disposing the filter between the filter mounting member and the supply body, and forming an outer portion by integral molding so that the outer portion continues over a region of the filter disposed between the filter mounting member and the supply member so as to integrate and fix the filter mounting member, the supply body, and the filter in the supply member.

BRIEF DESCRIPTION OF THE DRAWINGS

The invention will be described with reference to the accompanying drawings, wherein like numbers reference like elements.

DESCRIPTION OF EXEMPLARY EMBODIMENTS

The exemplary embodiments of the invention will now be described with reference to the drawings.

First Embodiment

Figure 1:
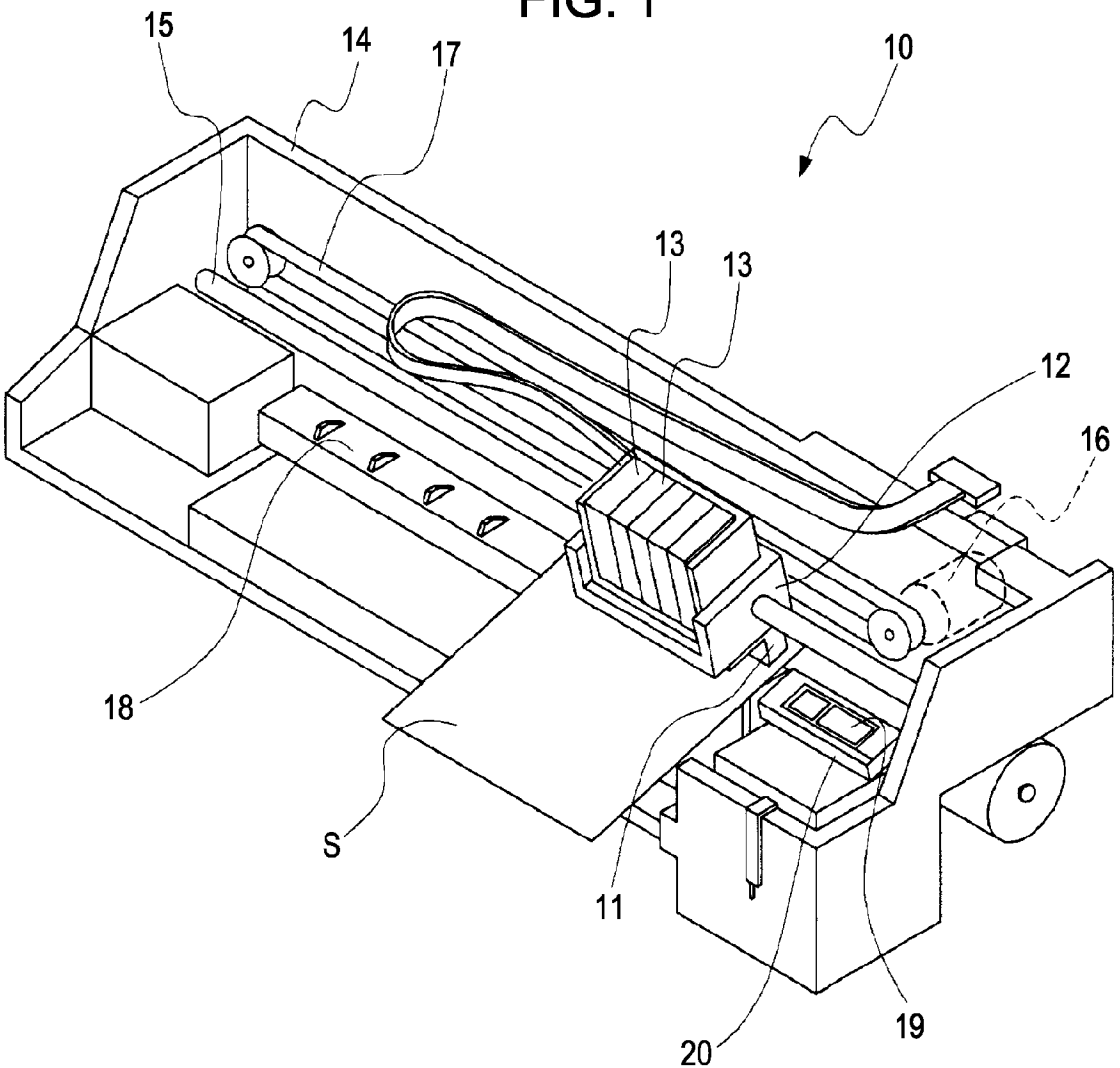
FIG. 1 is a schematic perspective view of a recording apparatus according to a first embodiment of the invention.

FIG. 1 is a schematic perspective view of an ink jet recording apparatus, which is an example of a liquid ejecting apparatus, according to a first embodiment of the invention. As shown in FIG. 1, the ink jet recording apparatus 10 of the invention has an ink jet recording head (hereinafter also referred to as recording head) 11, which is an example of a liquid ejecting head which is capable of discharging ink droplets. The recording head 11 is fixed to a carriage 12. A plurality of ink cartridges 13 are detachably attached to the recording head 11. The ink cartridges 13 contain different colors of ink, for example, black (B), light black (LB), cyan (C), magenta (M), and yellow (Y). The ink cartridges 13 act as liquid storage units.

The carriage 12 on which the recording head 11 is mounted is slidably attached to a carriage shaft 15 which is attached to an apparatus main body 14. The drive force of a drive motor 16 is transmitted to the carriage 12 through a plurality of gears (not shown) and a timing belt 17 (not shown), which causes the carriage 12 to move along the carriage shaft 15. A platen 18 is provided in the apparatus main body 14 along the carriage shaft 15. A recording medium S such as paper fed from a paper feed unit (not shown) is transported on the platen 18.

A capping unit 20 is provided at a position corresponding to the home position of the carriage 12, which, in this embodiment, is near one end of the carriage shaft 15. The capping unit 20 has a cap member 19 that seals a nozzle forming surface of the recording head 11. The cap member 19 seals the nozzle forming surface in which nozzle openings are formed, thereby preventing the ink in the nozzles from drying. The cap member 19 also functions as an ink receiver during flushing operations.

Figure 2:
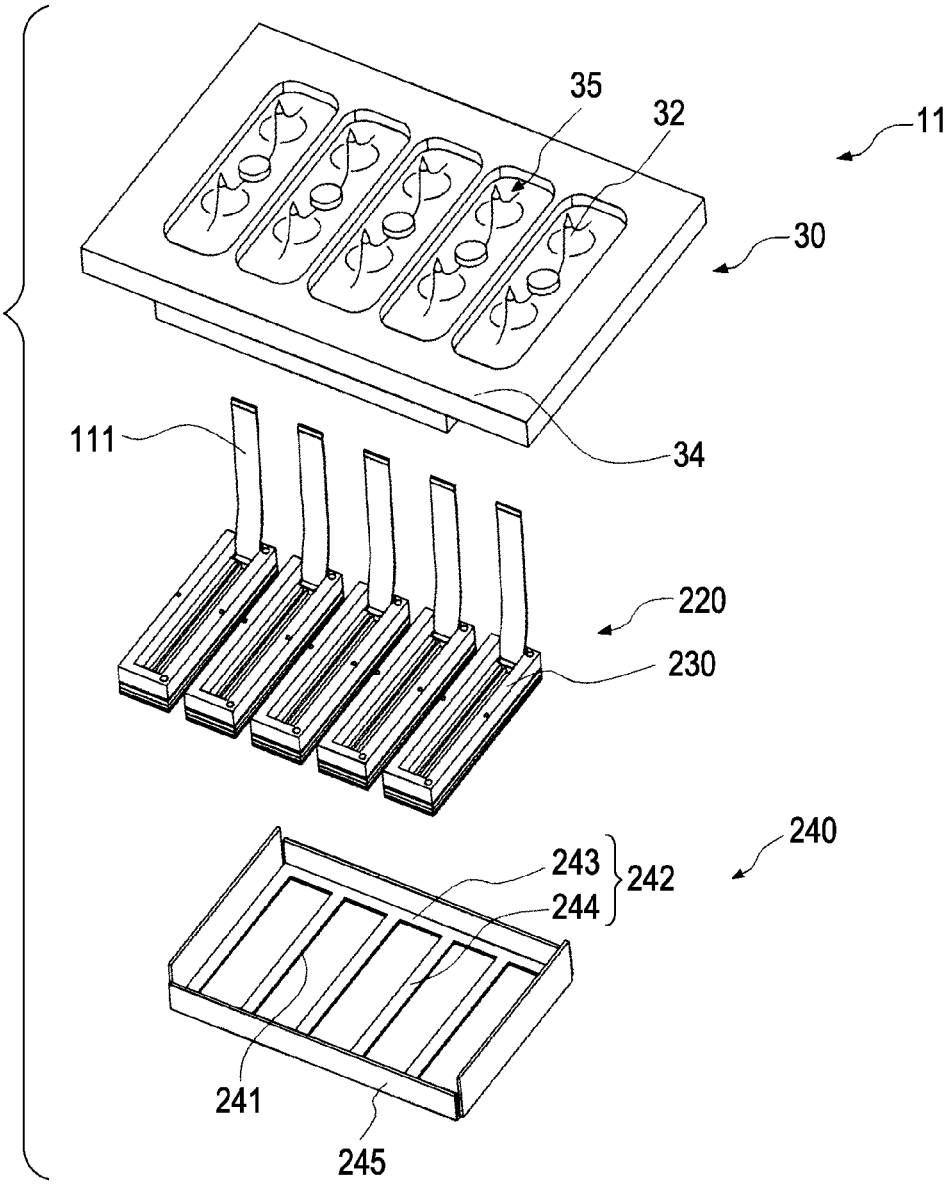
FIG. 2 is an exploded perspective view of a recording head according to a first embodiment of the invention.

The recording head 11 according to the first embodiment will be described. FIG. 2 is a schematic perspective view of an ink jet recording head, which is an example of a liquid ejecting head, according to the first embodiment.

As shown in FIG. 2, the recording head 11 has a supply member 30 such as a cartridge case, head main bodies 220, and a cover head 240. The ink cartridges 13 are fixed to the supply member 30. The head main bodies 220 are fixed the supply member 30 on the opposite side from where the ink cartridges 13 are fixed. The cover head 240 is provided on the liquid ejecting surfaces of the head main bodies 220.

Figure 3:
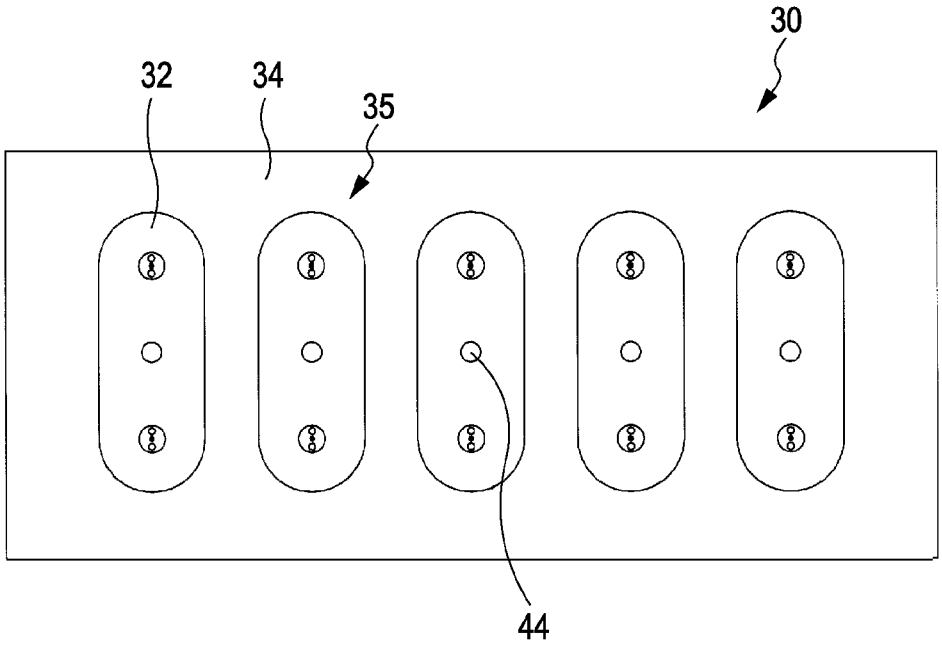
FIG. 3 is a top view of a supply member according to a first embodiment of the invention.
Figure 4:
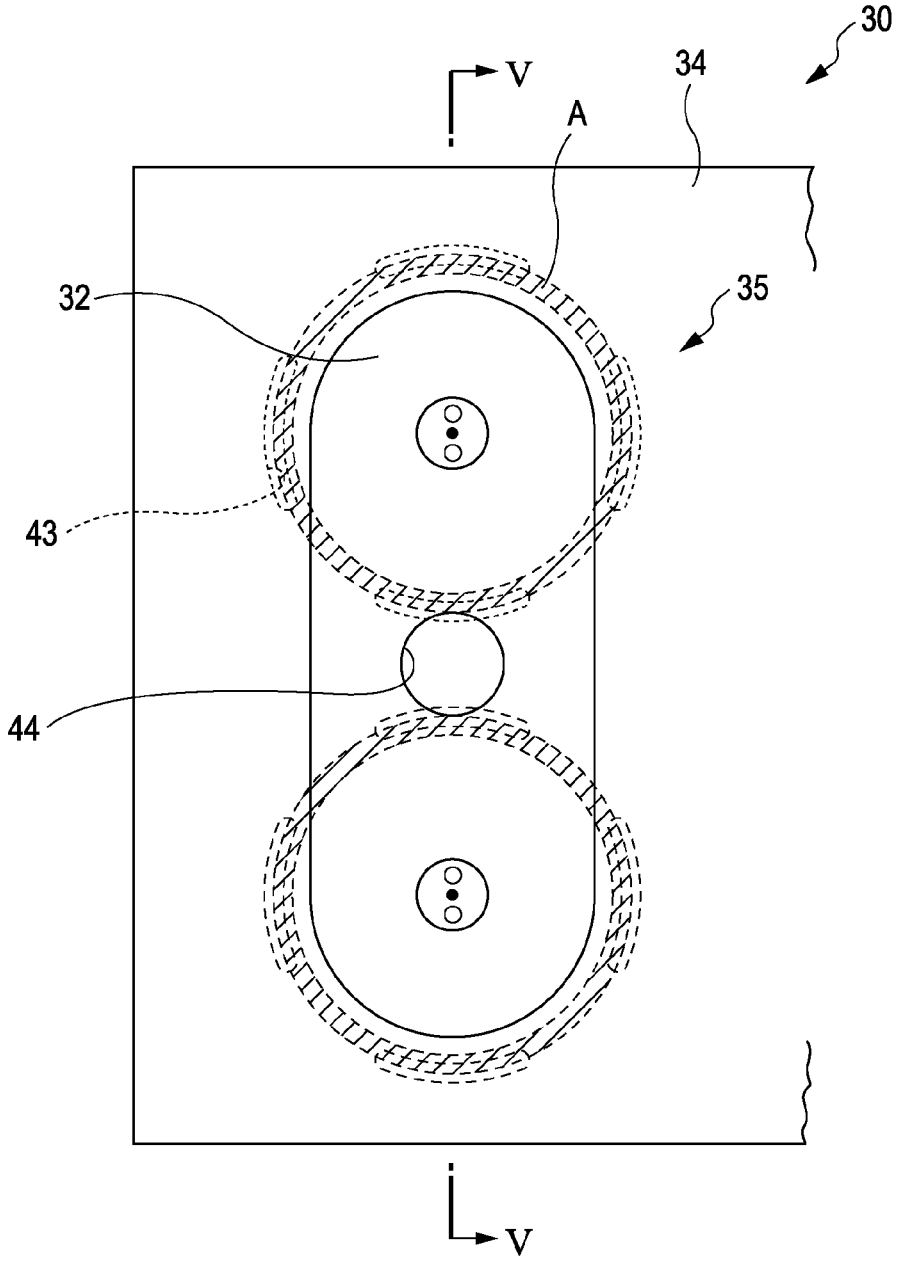
FIG. 4 is an enlarged top view of a main part of a supply member according to a first embodiment of the invention.
Figure 5:
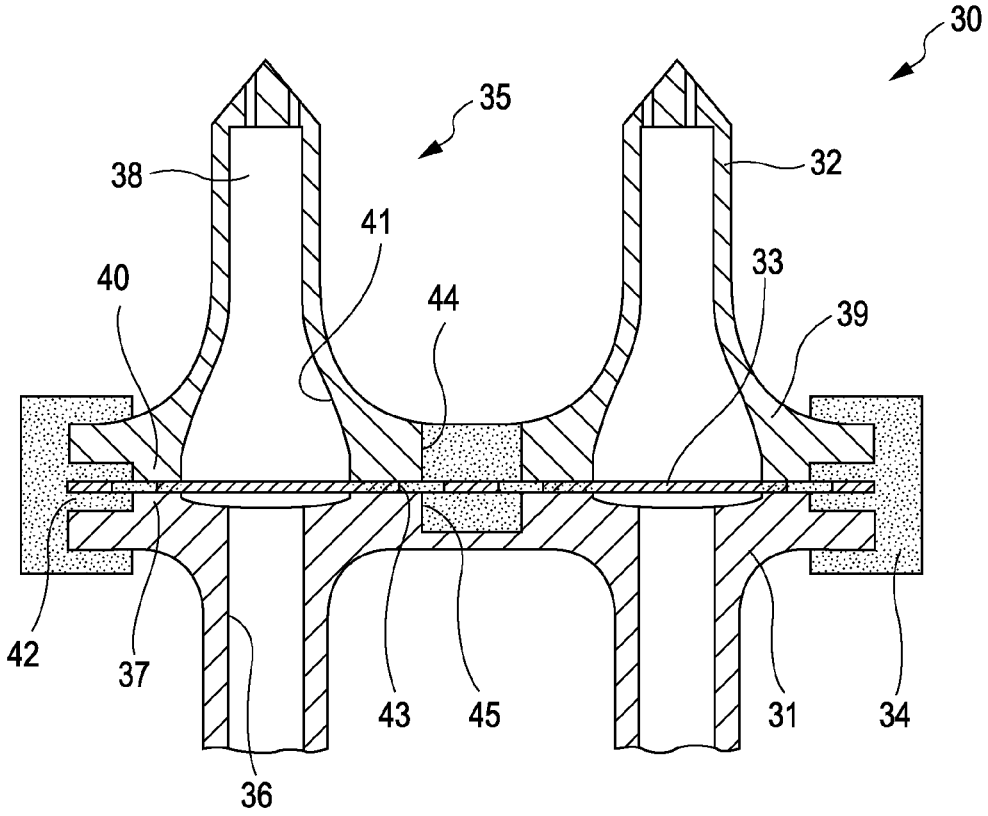
FIG. 5 is a sectional view of a supply member according to a first embodiment of the invention.

First, the supply member 30 will be described in detail. FIG. 3 is a top view of the supply member 30. FIG. 4 is an enlarged top view of a main part of the supply member 30. FIG. 5 is a sectional view taken along line V-V of FIG. 4.

As shown in FIG. 5, the supply member 30 has a supply member main body 31, supply needles 32, a filter 33, and an outer portion 34. The supply member main body 31 acts as a filter mounting member. The supply needles 32 are provided on one side of the supply member main body 31 and act as supply members. The filter 33 is provided between the supply member main body 31 and the supply needles 32. The outer portion 34 is provided around the supply member main body 31 and the supply needle 32.

The supply member 30 has supply body forming portions 35 on one side thereof. The ink cartridges 13 are attached to the supply body forming portion 35. Of course, the ink cartridges 13 do not have to be directly attached to the supply body forming portions 35. Rather, ink may be brought from liquid storage units through tubes to the supply body forming portions 35.

The supply member main body 31 is provided with liquid supply passages 36 for supplying ink from the ink cartridges 13 to the head main bodies 220. The liquid supply passages 36 are located downstream of the filter 33. One end of each of the liquid supply passages 36 open in the supply body forming portions 35, while the other ends thereof open toward the head main bodies 220. A plurality of liquid supply passages 36 are arranged in the longitudinal direction of the supply member main body 31. Each ink cartridge 13 is provided with its own liquid supply passages 36.

The supply body forming portions 35 of the supply member main body 31 have protrusions 37 provided around the openings of the liquid supply passages 36. The filter 33 is disposed between the protrusions 37 and the supply needles 32.

The supply needles 32 are fixed to the surface of the supply member main body 31 (the supply body forming portions 35), and have through passages 38 which communicate with the liquid supply passages 36. The supply needles 32 are members for supplying ink from the ink cartridges 13 to the supply member main body 31.

The supply needles 32 each have a flange portion 39 on the side near the supply member main body 31. The flange portion 39 has a protrusion 40 which corresponds to the protrusions 37 of the supply member main body 31. The filter 33 is disposed between the protrusions 40 of the supply needles 32 and the protrusions 37 of the supply member main body 31.

In the embodiment, two supply needles 32 are integrated with each other so as to form a single member, and such a single member is provided for each pair of liquid supply passages. That is, in the embodiment, as shown in FIG. 3, five members provide ten liquid supply passages 36 (not shown).

A filter chamber 41 is provided in a region of the through passage 38 of each supply needle 32 connected to a corresponding liquid supply passage 36. The inside diameter of the filter chamber 41 is larger than that of the other region of the through passage 38. In the first embodiment, the inside diameter of the filter chamber 41 increases toward the supply member main body 31. The inside diameter of the filter chamber 41 is larger than that of the other region of the through passage 38 in order to increase the area of the filter 33 through which ink passes in order to reduce the resistance of the ink at the filter 33.

The filter 33 is, for example, a sheet produced by weaving fine metal fibers, and is disposed between the supply member main body 31 and the supply needles 32. In the embodiment, the filter 33 has a size such that it extends to the outside of the region disposed between the supply member main body 31 and the supply needles 32. That is, the filter 33 is provided so as to extend into an outer depression 42 defined by the protrusions 37 of the supply member main body 31 and the protrusions 40 of the supply needles 32.

Filters 33 may be provided for every liquid supply channel 36. Alternatively, a filter 33 covering two or more liquid supply passages 36 may be provided for every two or more liquid supply passages 36. In the first embodiment, a single filter 33 which covers all the liquid supply passages is provided. The filter 33 extends into the outer depression 42 defined by the protrusions 37 of the supply member main body 31 and the protrusions 40 of the supply needles 32. Since the filter 33 is provided so as to extend into the depression 42, the extending region of the filter is disposed between parts of the outer portion 34, which will hereinafter be described in detail, so that the filter can be prevented from twisting and/or peeling.

A plurality of through holes 43 are provided discontinuously in regions of the filter 33 disposed between the protrusions 37 of the supply member main body 31 and the protrusions 40 of the supply needles 32. In the embodiment, as shown in FIG. 4, four through holes 43 are provided at even intervals around each liquid supply passage 36. Each through hole 43 opens the area between a protrusion 37 of the supply member main body 31 and a protrusion 40 of a supply needle 32 on the outside of the region A.

By providing a filter 33 with the through holes 43, an outer portion 34 can be formed by integral molding between two integrated supply needles 32 and in the regions A where the filter 33 is disposed between the protrusions 37 of the supply member main body 31 and the protrusions 40 of the supply needles 32. That is, when the outer portion 34 is formed by integral molding, the through holes 43 can be filled with the material forming the outer portion 34 through the through holes 43 of the filter 33 on the sides of the regions A where the filter 33 is disposed between the supply member main body 31 and the supply needles 32. Thus, the outer portion 34 can be disposed to the utmost limit of the effective area. In addition, when the outer portion 34 is formed by integral molding, the spaces between through holes 43 adjacent to each other in the circumferential direction in the regions A disposed between the supply member main body 31 and the supply needles 32 can be filled with the outer portion 34 through the through holes 43 of the filter 33. Thus, the outer portion 34 can be provided continuously around the liquid supply passages 36, the liquid supply passages 36 are reliably sealed, preventing any leakage of ink.

Since the filter 33 is provided with the through holes 43 in such a manner that the through holes 43 open in the area between the supply member main body 31 and the supply needles 32 outside of the regions A, when the outer portion 34 is formed by integral molding, molten resin forming the outer portion 34 can easily flow vertically through the through holes 43 of the filter 33.

The outer portion 34 is formed of resin by integral molding around the supply member main body 31 and the supply needles 32. In the embodiment, a single outer portion 34 is provided around the boundaries between the plurality of supply needles 32 and the supply member main body 31.

Such an outer portion 34 is provided around the supply member main body 31 and the supply needles 32 so as to cover the ends of the supply member main body 31 and the supply needles 32. Thus, the supply member main body 31 and the supply needles 32 are fixed to and integrated with each other. That is, the depression 42 defined by the protrusions 37 of the supply member main body 31 and the protrusions 40 of the supply needles 32 is filled with the outer portion 34, and the outer portion 34 is provided in such a manner that the part of the filter 33 extending into the depression 42 is disposed between parts of the outer portion 34.

As shown in FIG. 4, the outer portion 34 extends over the regions A of the filter 33 disposed between the supply member main body 31 and the supply needles 32. That is, since the filter 33 of the embodiment is produced by weaving fine metal fibers, the fine empty spaces in the filter 33 are filled with molten resin when the outer portion 34 is formed by integral molding, causing the outer portion 34 to be formed between the protrusions 37 of the supply member main body 31 and the protrusions 40 of the supply needles 32.

Such an outer portion 34 is formed by integral molding around the supply member main body 31 and the supply needles 32, the supply member main body 31, the supply needles 32, and the filter 33 are fixed together in order to form an integrated supply member 30.

Integrating the supply member main body 31, the supply needles 32, and the filter 33 using the outer portion 34 formed by integral molding eliminates the need for the additional space in order to weld the supply needles 32 and the filter 33 to the supply member main body 31. Therefore, the distance between adjacent supply needles 32 can be shortened, and the head can be reduced in size. In addition, there is no need to reduce the area of the filter 33 in order to reduce the head size. Therefore, the dynamic pressure is prevented from increasing, and there is no need to increase the drive voltage for driving the piezoelectric elements 300.

In addition, by using the outer portion 34, the filter 33 and the supply needles 32 can be fixed to the supply member main body 31 at the same time. Thus, there is no need to separately fix the filter 33 and the supply needles 32 to the supply member main body 31. Therefore, the production cost can be reduced.

Moreover, since the supply member main body 31 and the supply needles 32 are fixed by the outer portion 34, the supply member main body 31 and the supply needles 32 can be prevented from being separated by a gap, and ink can be prevented from leaking through such a gap.

In the embodiment, a filling hole 44 provided between two supply needles and a communication hole 45 in the supply member main body 31 are also filled with the outer portion 34. The filling hole 44 and the communication hole 45 are for providing the outer portion 34 between the area around the liquid supply passages 36 and the regions of the filter 33 where the protrusions 37 of the supply member main body 31 and the protrusions 40 of the supply needles 32 face each other That is, when a plurality of supply needles 32 are integrated and a single continuous outer portion 34 as in the first embodiment, the outer portion 34 can be formed between the regions where the protrusions 37 of the supply member main body 31 and the protrusions 40 of the supply needles 32 face each other by providing the filling hole 44 and the communicating hole 45.

Figure 6A:
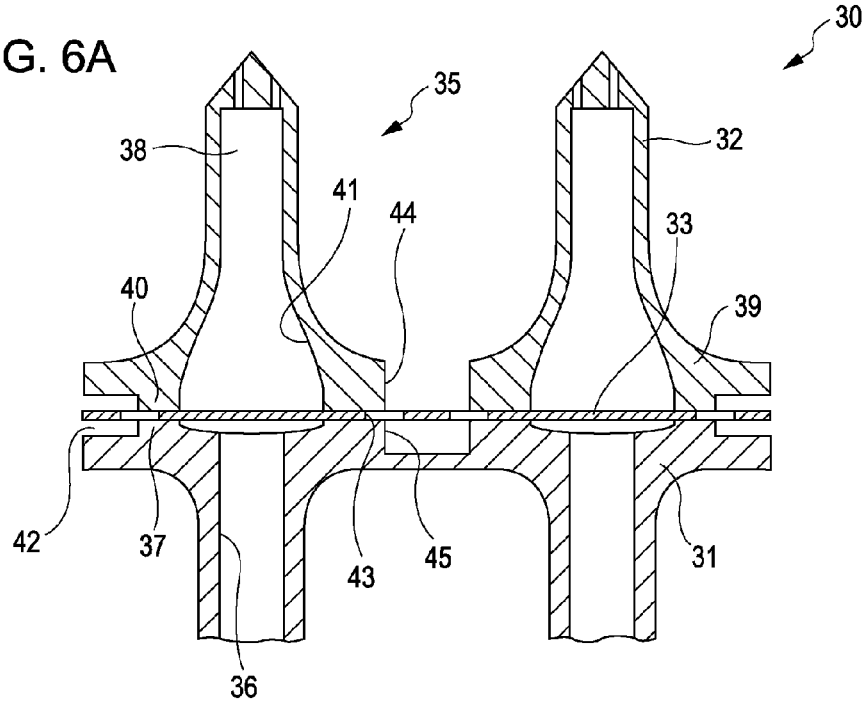
FIGS. 6A and 6B are sectional views showing a method for making a supply member according to a first embodiment of the invention.
Figure 6B:
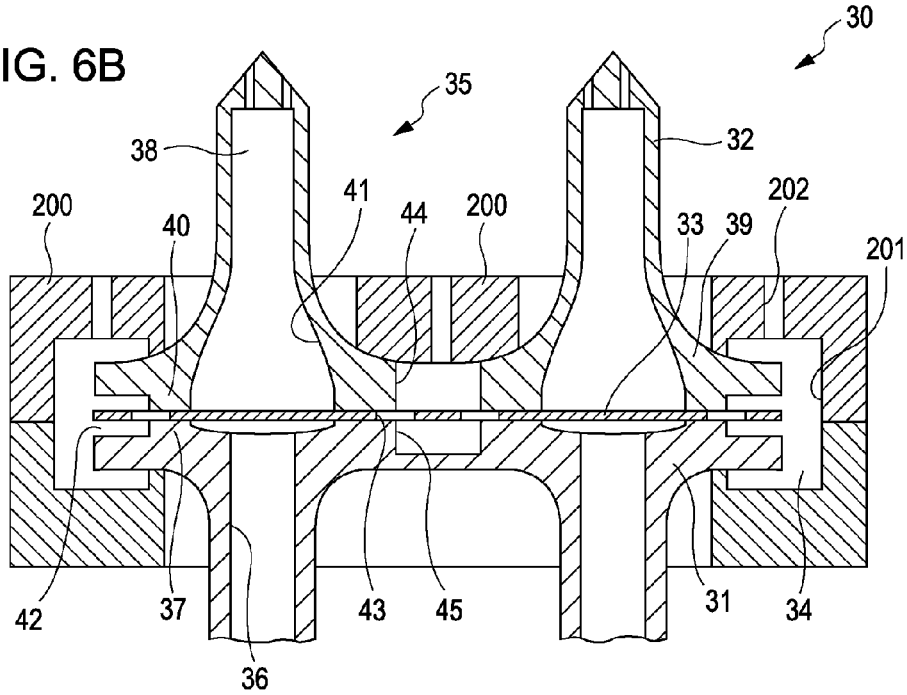
Figure 7:
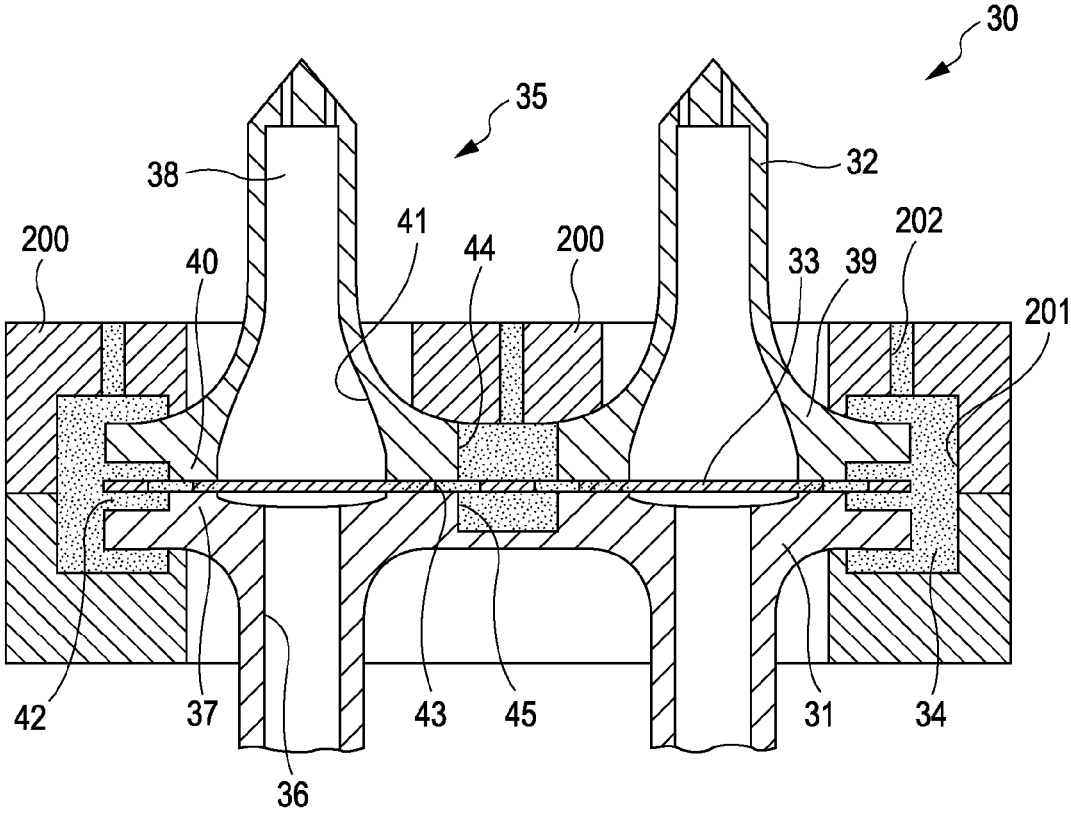
FIG. 7 is a sectional view showing a method for making a supply member according to a first embodiment of the invention.

A method for making such an ink jet recording head 11, particularly a supply member 30 will be described in detail. FIGS. 6A, 6B, and 7 are sectional views showing a method for making a supply member.

First, as shown in FIG. 6A, a filter 33 is disposed between a supply member main body 31 and supply needles 32. That is, protrusions 37 of the supply member main body 31 and protrusions 40 of the supply needles 32 are brought into contact with each other with the filter 33 disposed in the middle of the two protrusions 37 and 40.

Next, as shown in FIG. 6B, a mold 200 is set around the boundaries between the supply member main body 31 and the supply needles 32. The mold 200 is divided into upper and lower halves, and has a cavity 201 in which an outer portion 34 is formed. The mold 200 is provided with gates 202 that expose the cavity 201 to the outside.

As shown in FIG. 7, an outer portion 34 is formed by an integral molding process in order to form a supply member 30. More specifically, the cavity 201 is filled with molten resin through the gates 202 of the mold 200, and thereby an outer portion 34 is formed. At this time, the fine empty spaces in the filter 33 are also filled with molten resin. Thus, regions between the protrusions 37 of the supply member main body 31 and the protrusions 40 of the supply needles 32, that is, regions A (see FIG. 4) of the filter 33 disposed between the supply member main body 31 and the supply needles 32 are filled with molten resin.

The outer portion 34 is thereby provided around the liquid supply passages 36 so as to fix and integrate the supply member main body 31, the supply needles 32, and the filter 33.

As described above, since the filter 33 of the embodiment is provided with through holes 43, molten resin can easily flow vertically through the through holes 43, and the mold 200 can be easily filled with molten resin. In addition, by providing the filter 33 with the through holes 43, the regions between the protrusions 37 of the supply member main body 31 and the protrusions 40 of the supply needles 32 can be filled with resin, and the liquid supply passages 36 can be sealed with the outer portion 34.

Forming the supply member 30 in this way eliminates the need for an additional process to weld the filter 33 and the supply needles 32 to the supply member main body 31. The supply member main body 31, the supply needles 32, and the filter 33 can be fixed and integrated in one process where the outer portion 34 is formed by integral molding. Therefore, the production process can be simplified and the cost can be reduced.

Figure 8:
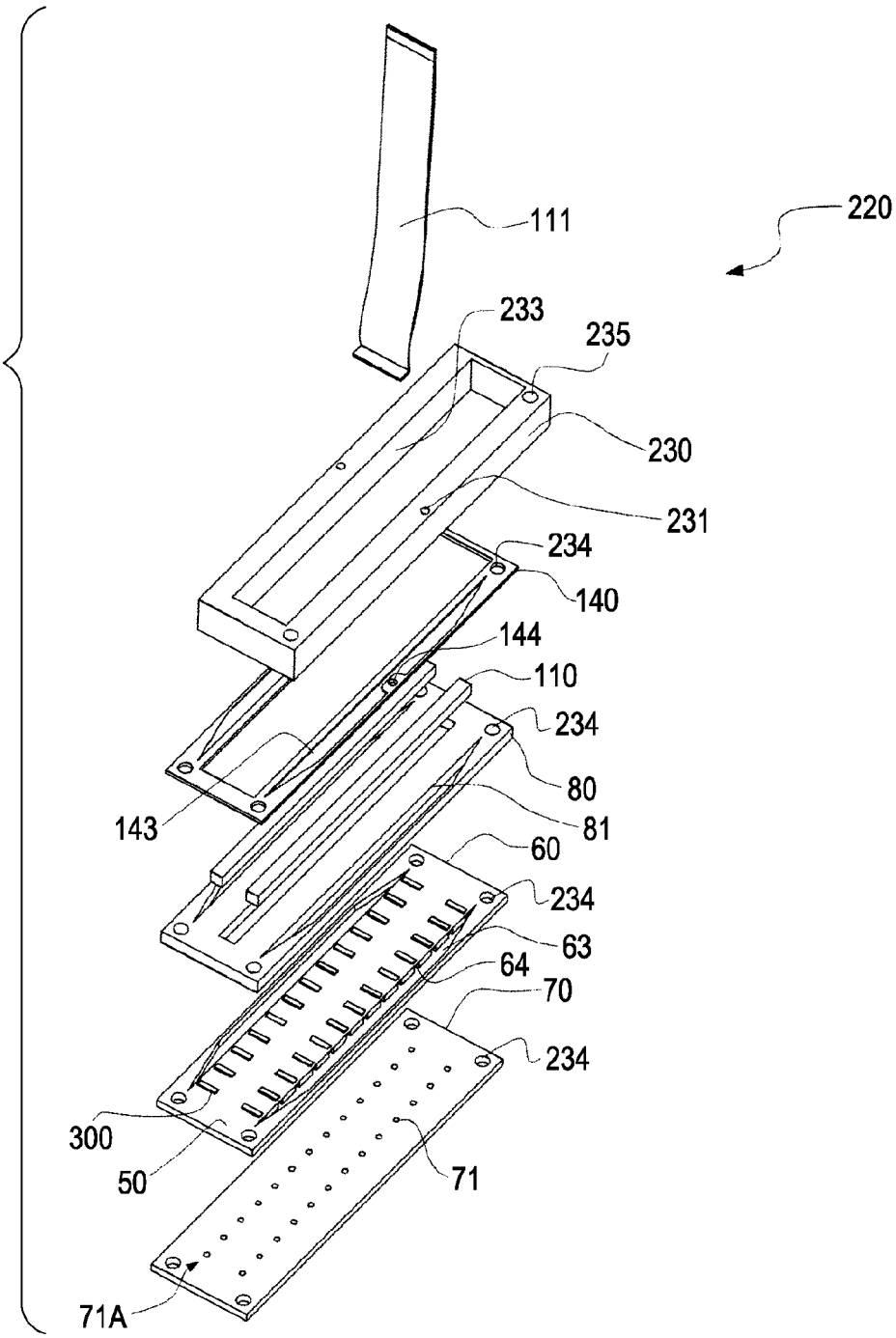
FIG. 8 is an exploded perspective view of a head main body according to a first embodiment of the invention.
Figure 9:
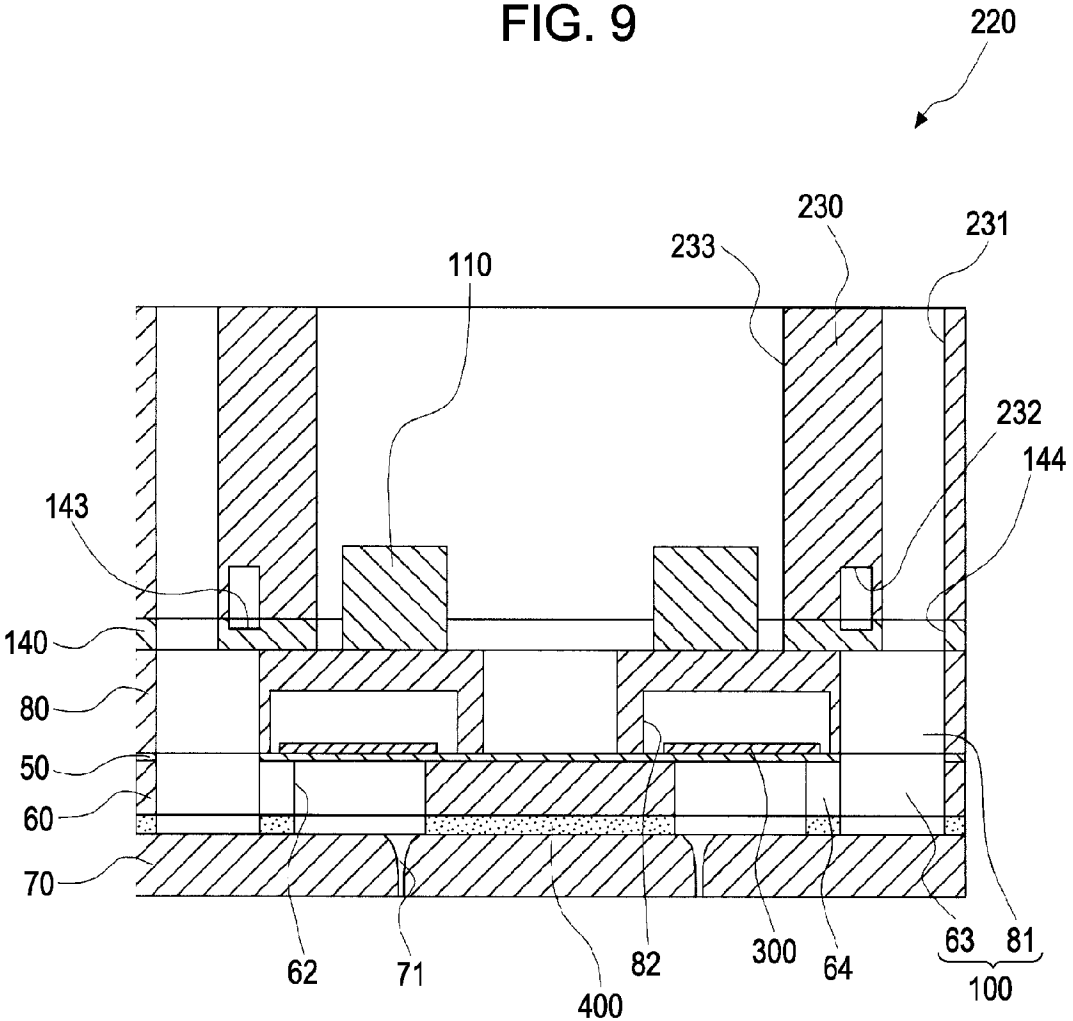
FIG. 9 is a sectional view of a head main body according to a first embodiment of the invention.

Head main bodies 220 are provided on the opposite side of the supply member 30 from the supply needles 32. The head main bodies 220 will now be described. FIG. 8 is an exploded perspective view of a head main body 220. FIG. 9 is a sectional view of a head main body 220.

As shown in FIG. 8, a flow-path forming substrate 60 constituting a head main body 220 is made of a silicon single crystal substrate in the first embodiment. On one side thereof is formed an elastic film 50 made of silicon dioxide. In the flow-path forming substrate 60, two rows of pressure generating chambers 62 are formed by performing anisotropic etching from the opposite side. The pressure generating chambers 62 in each row are separated from one another by partitions, and are arranged along the width direction of the pressure generating chambers 62. On the outer side of each row in the longitudinal direction of the pressure generating chambers 62, a communication portion 63 is formed. Each communication portion 63 is communicated with a corresponding reservoir portion 81 provided in a reservoir forming substrate 80 described more fully below. The communication portion 63 constitutes a reservoir 100 serving as a common ink chamber shared by the pressure generating chambers 62 in each row. Each communication portion 63 is communicated with one end of each pressure generating chamber 62 in the longitudinal direction via an ink supply passage 64. That is, in the embodiment, the pressure generating chambers 62, the communication portions 63, and the ink supply passages 64 are provided as liquid flow paths formed in the flow-path forming substrate 60.

To the opening side of the flow-path forming substrate 60 is bonded a nozzle plate 70 with adhesive 400. The nozzle plate 70 has nozzle openings formed therein. Specifically, a plurality of nozzle plates 70 are provided so as to correspond to a plurality of head main bodies 220. The area of the nozzle plate 70 is slightly larger than that of each exposure opening portion 241 of a cover head 240 described more fully below. The edge of the undersurface of the nozzle plate 70 is fixed to the cover head 240, for example, with adhesive. Each nozzle opening 71 of the nozzle plate 70 communicates with the opposite end of a corresponding pressure generating chamber 62 from the ink supply passage 64. In the embodiment, since the flow-path forming substrate 60 is provided with two rows of pressure generating chambers 62, one head main body 220 has two rows 71A of nozzle openings 71. In the embodiment, the surface of the nozzle plate 70 on which the nozzle openings 71 open serves as a liquid ejecting surface A. Such a nozzle plate 70 is made, for example, of a silicon single crystal substrate or a metal substrate such as a stainless steel substrate.

Piezoelectric elements 300 are formed on the top of the elastic film 50 on the opposite side of the flow-path forming substrate 60 from the side of the substrate with the opening. Each piezoelectric element 300 is formed by sequentially laminating a lower electrode film made of metal, a piezoelectric layer made of a piezoelectric material such as lead zirconate titanate (PZT), and an upper electrode film made of metal.

A reservoir forming substrate 80 which has reservoir portions 81 is joined to the top of the flow-path forming substrate 60 on which the piezoelectric elements 300 are formed. Each reservoir portion 81 constitutes at least a part of a reservoir 100. In the embodiment, each reservoir portion 81 is formed through the reservoir forming substrate 80 in the thickness direction. The reservoir portions 81 extend in the direction of the width of the pressure generating chambers 62 and communicate with a corresponding communication portion 63 of the flow-path forming substrate 60, and constitute a reservoir 100 serving as a common ink chamber shared by the pressure generating chambers 62.

Piezoelectric element holding portions 82 are provided in the regions of the reservoir forming substrate 80 facing the piezoelectric elements 300, and have spaces so that the piezoelectric elements 300 can move.

On the top of the reservoir forming substrate 80 is provided drive circuits 110 for driving each piezoelectric element 300. Each drive circuit 110 is, for example, a semiconductor integrated circuit (IC). Each terminal of the drive circuits 110 is connected, for example, via a bonding wire (not shown) with wiring connected with the individual electrode of each piezoelectric element 300. Each terminal of the drive circuits 110 is connected with the outside via an external wiring line 111 such as a flexible printed circuit board (FPC), and receives various signals such as a printing signal from the outside via the external wiring line 111.

To the top of such a reservoir forming substrate 80 is joined a compliance substrate 140. In the regions of the compliance substrate 140 facing the reservoirs 100, ink introducing ports 144 for supplying ink to the reservoirs 100 are formed through the compliance substrate 140 in the thickness direction. The regions of the compliance substrate 140 facing the reservoir 100 other than the ink introducing ports 144 are flexible portions 143 having a small thickness. The reservoirs 100 are sealed by the flexible portions 143. The flexible portions 143 give compliance to the insides of the reservoirs 100.

On the top of the compliance substrate 140 is fixed a head case 230.

The head case 230 is provided with ink supply communication passages 231. The ink supply communication passages 231 are communicated with the ink introducing ports 144 and the liquid supply passages 36 of the supply member 30 and supply ink from the supply member 30 to the ink introducing ports 144. The head case 230 has groove portions 232 formed in the surface thereof facing the flexible portions 143 of the compliance substrate 140 so that the flexible portions 143 can be deformed. The head case 230 has a drive circuit holding portion 233 formed therein in the thickness direction in the region facing the drive circuits 110 provided on the top of the reservoir forming substrate 80. The external wiring line 111 is connected with the drive circuits 110 through the drive circuit holding portion 233.

The head main body 220 held by the supply member 30 with the head case 230 in between, is positioned and held by the cover head 240. As shown in FIG. 2, the cover head 240 is box-shaped so as to cover the liquid ejecting surfaces of the five head main bodies 220. The cover head 240 has exposure openings 241 that expose the nozzle openings 71, and a joining portion 242 that defines the exposure openings 241. The joining portion 242 is joined to at least both ends of the liquid ejecting surfaces of the head main bodies 220 in the direction of the rows 71A of nozzle openings 71.

The joining portion 242 is composed of a frame portion 243 provided around the liquid ejecting surfaces of the head main bodies 220, and beam portions 244 provided between adjacent head main bodies 220 which separate the exposure openings 241. The frame portion 243 and the beam portions 244 are joined to the liquid ejecting surfaces of the head main bodies 220, that is, to the surfaces of the nozzle plates 70.

The cover head 240 has upstanding side wall portions 245, which cover the sides of the head main bodies 220 and surround the liquid ejecting surfaces.

As described above, the joining portion 242 of the cover head 240 is bonded to the liquid ejecting surfaces of the head main bodies 220. Therefore, the difference in level between the liquid ejecting surfaces and the cover head 240 can be reduced. Ink can be prevented from remaining on the liquid ejecting surfaces after wiping the liquid ejecting surfaces and the suction operation has been performed. Since the beam portions 244 cover the spaces between adjacent head main bodies 220, ink does not enter the spaces between adjacent head main bodies 220, and the piezoelectric elements 300 and the drive circuits 110 can be prevented from being deteriorated or damaged by ink. The liquid ejecting surfaces of the head main bodies 220 are tightly bonded to the cover head 240 with adhesive. Therefore, a recording medium S can be prevented from entering the gap between the head main bodies 220, and the deformation of the cover head 240 and a paper jam can be prevented. In addition, since the side wall portions 245 cover the sides of the head main bodies 220, ink can be reliably prevented from spreading to the sides of the head main bodies 220. Moreover, since the cover head 240 is provided with the joining portion 242 joined to the liquid ejecting surfaces of the head main bodies 220, each nozzle row 71A of the head main bodies 220 can be positioned relative to the cover head 240 with a high degree of accuracy.

Such a cover head 240 is formed, for example, of a metal material such as stainless steel, by pressing a metal plate or molding. When the cover head 240 is formed of a conductive metal material, grounding is possible. The cover head 240 and the nozzle plates 70 can be joined using any adhesive, for example, thermosetting epoxy adhesive or UV cure adhesive.

In the ink jet recording head 11 of the embodiment, ink is supplied from the ink cartridges 13 through the liquid supply passages 36. Ink flows through the ink supply communication passages 231 and the ink introducing ports 144, and the inside of the ink jet recording head 11 is filled with ink from the reservoirs 100 to the nozzle openings 71. In accordance with a recording signal from the drive circuit 110, a voltage is applied to each piezoelectric element 300 corresponding to each pressure generating chamber 62 to displace the elastic film 50 and the piezoelectric elements 300, and thereby the pressure in each pressure generating chamber 62 increases and ink droplets are discharged from the nozzle openings 71.

Second Embodiment

Figure 10A:
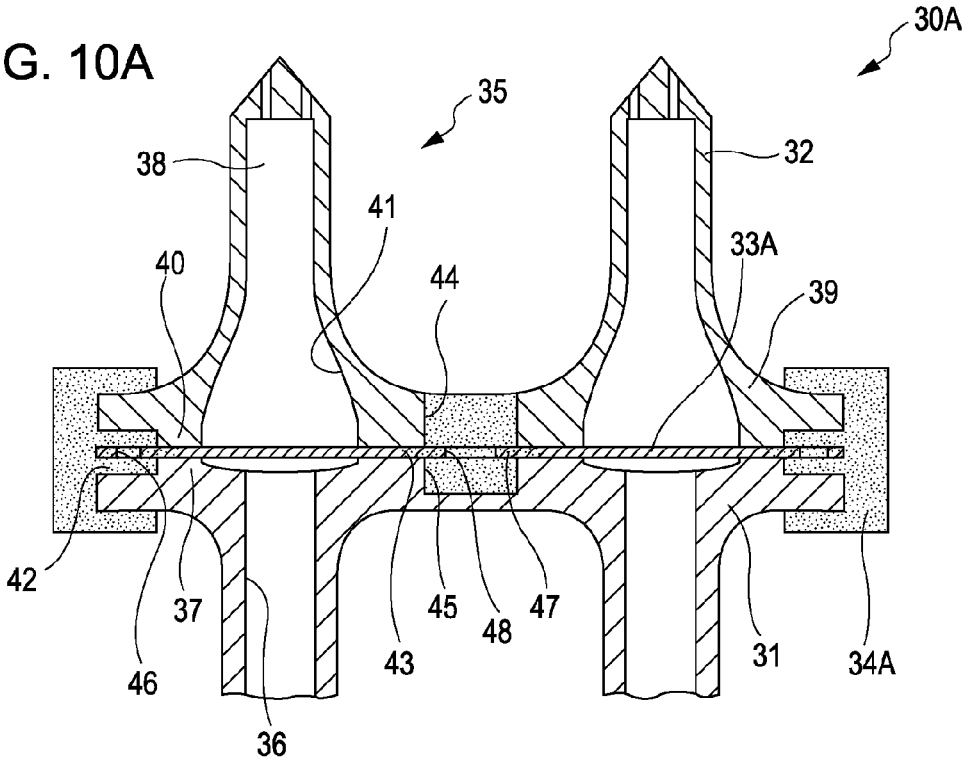
FIG. 10A is a sectional view of a supply member according to a second embodiment of the invention.
Figure 10B:
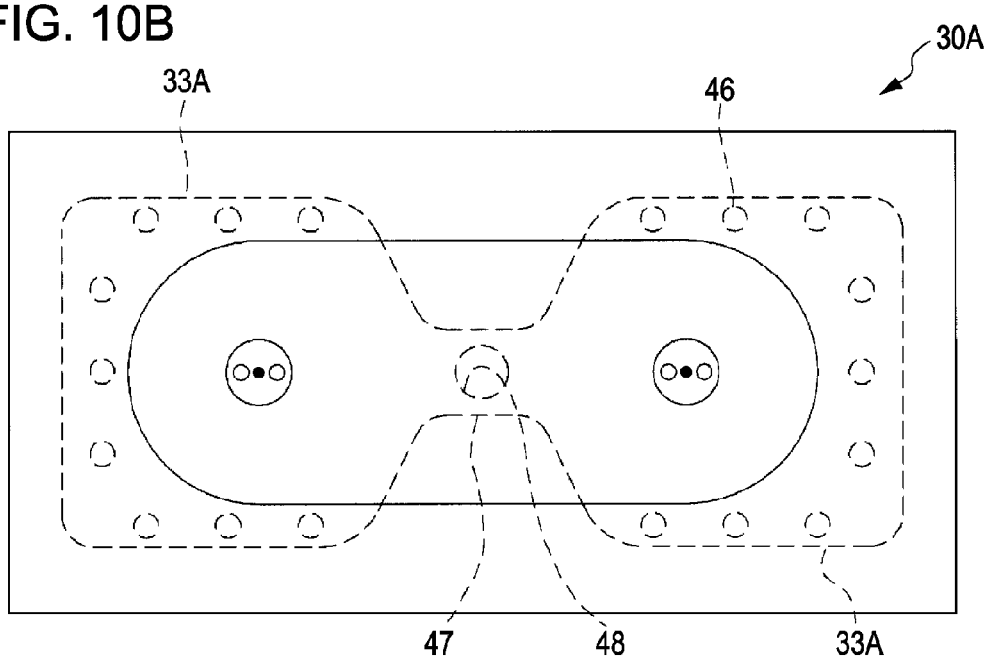
FIG. 10B is a top view of a supply member according to a second embodiment of the invention.

FIGS. 10A and 10B are a sectional view and a top view, respectively, of a supply member according to a second embodiment. In the supply member 30A of the second embodiment, the filter 33A has a plurality of through holes 46 formed in the peripheral portions thereof extending into an outer portion 34A. Also in the embodiment, a plurality of supply needles are integrated and a single continuous outer portion 34A is provided. The region of the filter 33A between liquid supply passages 36 which corresponds to a communication hole 45 forms a narrow communication portion 47. Therefore, the outer portion 34A extends so as to surround the communication portion 47, and thereby the region between the liquid supply passages 36 is reliably sealed by the outer portion 34A. In addition, the communication portion 47 of the filter 33A also has a through hole 48. Therefore, the region around the communication portion 47 is reliably sealed by the outer portion 34A.

Third Embodiment

Figure 11:
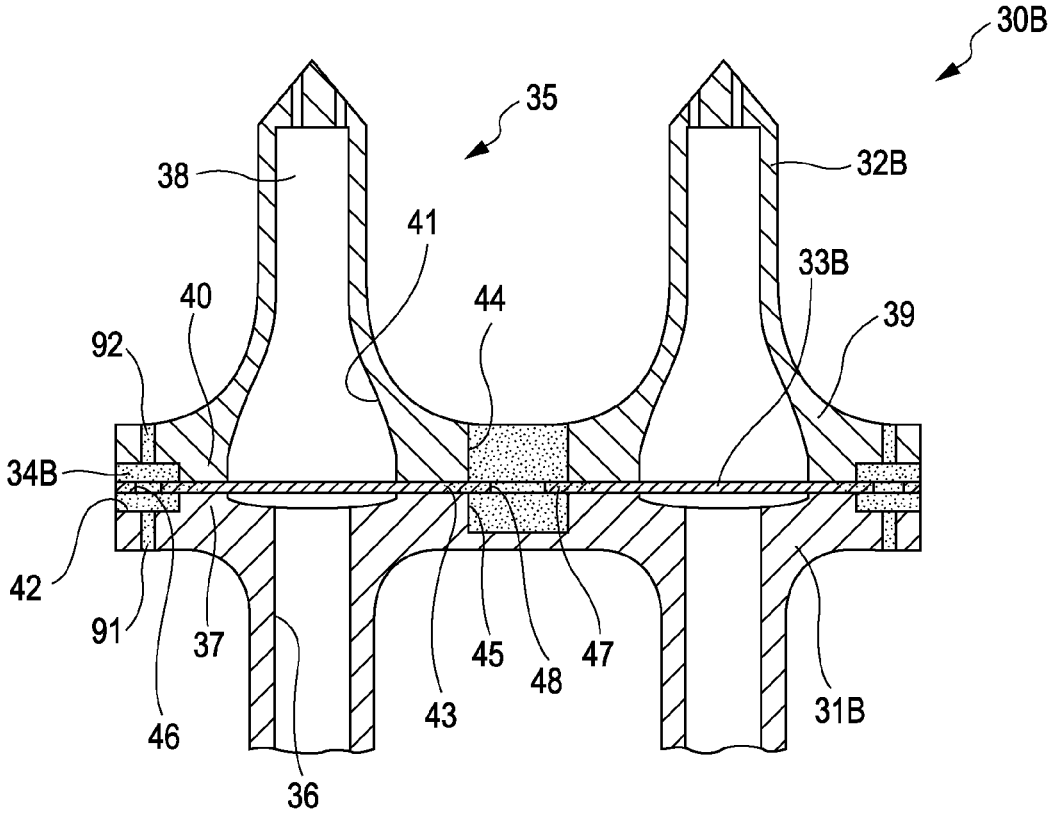
FIG. 11 is a sectional view of a supply member according to a third embodiment of the invention.

FIG. 11 is a sectional view of a supply member according to a third embodiment. In the supply member 30B of the third embodiment, an outer portion 34B exists within a region disposed between a supply member main body 31B and supply needles 32B but does not surround them. However, in this case, the outer portion 34B is provided around the regions of a filter 33B disposed between the supply member main body 31B and the supply needles 32B.

The peripheral portions of the supply member main body 31B and the supply needles 32B facing an outer portion 34B have fine through holes 91 and 92, respectively, extending from the surface facing the filter 33B to the opposite surface. The through holes 91 and 92 are provided separately from the through hole in the resin filling portion. The through holes 91 and 92 function as air vent holes at the time of the molding of the outer portion 34B, and strengthen the integration of the outer portion 34B with the supply member main body 31B and the supply needles 32B after the molding. Such through holes 91 or 92 may be provided in the supply member main body 31B or the supply needles 32B, or may not be provided at all. Since the outer portion 34B is provided so as to surround the supply member main body 31B and the supply needles 32B, if the through holes 91 and 92 are not provided, the outer portion 34B is sufficiently integrated with the supply member main body 31B and the supply needles 32B. In addition, since the outer portion 34B is directly in contact with a mold during the molding process, air vent holes do not always have to be provided.

Other Embodiments

The basic configuration of the invention is not limited to the above-described embodiments.

Although, in the above-described embodiment, a filter mounting member forms the whole supply member main body 31, it is possible to divide the supply member main body 31 into an upper half (on the filter 33 side) and a lower half (on the head main body 220 side), and to integrate the upper half with the filter 33 and the supply needles 32 as a filter mounting member. In this case, the lower half of the supply member main body 31 is attached to the integrated member so as to form a supply member 30.

Figure 12:
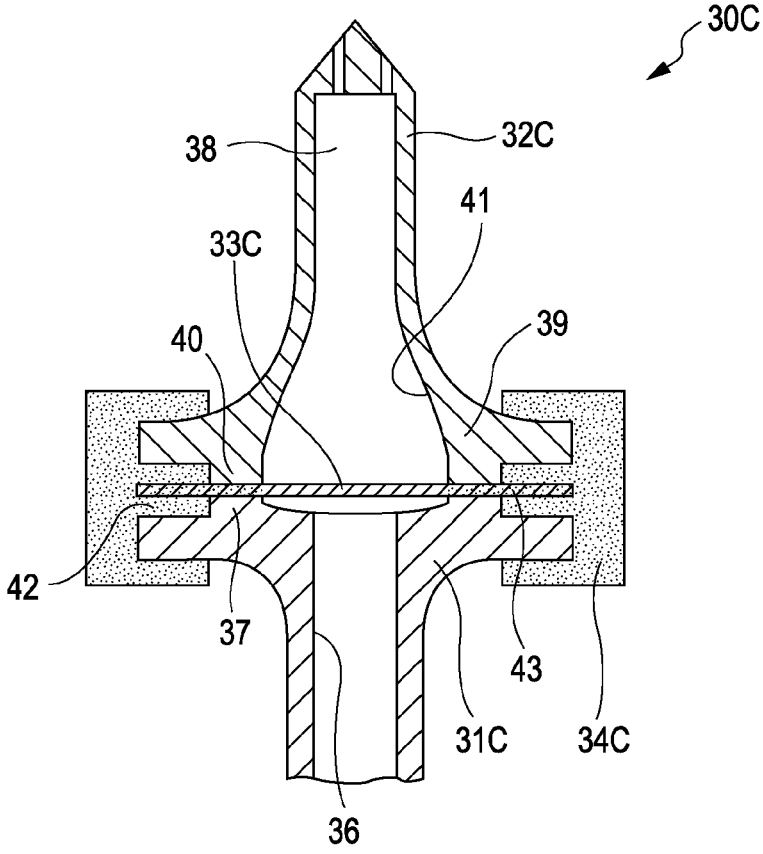
FIG. 12 is a sectional view of a supply member according to another embodiment of the invention.

In the above-described embodiments, two supply needles 32 are integrated to form a single member, and a single outer portion 34 is provided around a plurality of supply needles 32 and a supply member main body 31. However, the invention is not limited to this. For example, as shown in FIG. 12, it is possible to independently provide a supply member main body 31C and a supply needle 32C, and to provide an outer portion 34C around each of the supply member main body 31C and the supply needle 32C. In this case, there is no need to provide a filter 33C with through holes 43 as in the above-described first embodiment. The outer portion 34C can be easily formed without such through holes 43. Of course, through holes 46 may be provided as in the second embodiment. In the above-described first to third embodiments, an ink jet recording head 11 having a supply member 30 having a plurality of supply needles 32 is taken as an example. However, as shown in FIG. 12, an ink jet recording head may have a single supply member 30. The number and arrangement of supply members 30 and supply needles 32 are not limited to those in the above-described embodiments and as may be understood by one of ordinary skill in the art, the number and arrangement of supply members 30 and supply needles 32 may be modified without departing from the meaning and scope of the invention.

In the above-described embodiments, the ink cartridges 13 serving as liquid storage units are detachably attached to the supply member 30. However, the invention is not limited to this. It is possible to provide liquid storage units, for example, ink tanks outside the recording head 11 and to connect the liquid storage units and the recording head 11 with supply tubes. That is, although in the above-described embodiments, a needle-shaped supply needle 32 is taken as an example of a supply body, a supply body is not limited to a needle-shaped one.

In the above-described embodiments, a head main body 220 is provided for a plurality of liquid supply passages 36. Alternatively, it is possible to provide a plurality of head main bodies for each color of ink. In this case, a liquid supply passage 36 may be connected with a head main body, that is, a liquid supply passage 36 may be connected with a nozzle row provided in a head main body. Of course, a liquid supply passages 36 do not have to be connected with a nozzle row. A liquid supply passage 36 may communicate with a plurality of nozzle rows. Alternatively, a liquid supply passage 36 may communicate with half of a nozzle row. That is, a liquid supply passage 36 that communicates with at least a group of nozzle openings consists of a plurality of nozzle openings.

Although the above-described embodiments relate to an ink jet recording head 11 that discharges ink droplets, the invention is directed to various liquid ejecting heads. Liquid ejecting heads include recording heads used in image recording apparatuses such as printers, color material ejecting heads used for producing color filters of liquid crystal displays, electrode material ejecting heads used for forming electrodes of organic EL displays, FEDs (Field Emission Displays), and so forth, and bioorganic substance ejecting heads used for producing biochips.

What is claimed is:

1. A liquid ejecting head comprising:

a head main body capable of ejecting a liquid supplied from a liquid storage unit; and a supply member forming a liquid supply passage for supplying the liquid from the liquid storage unit to the head main body, the supply member comprising a filter mounting member, a supply body that supplies the filter mounting member with the liquid, a filter provided between the filter mounting member and the supply body, and outer portion provided around a region of the filter which is formed by an integral molding process, wherein the outer portion fixes the filter mounting member, the supply body, and the filter in the supply member, wherein a peripheral portion of at least one of the filter mounting member and the supply body corresponding to the outer portion is provided with a hole that extends from a surface facing the filter to the opposite surface of the peripheral portion, wherein the filter is provided so as to extend beyond the area disposed between the filter mounting member and the supply body, the extended area being disposed between portions of the outer portion, wherein a plurality of through holes are provided in the region of the filter disposed between portions of the outer portion.

2. The liquid ejecting head according to claim 1, wherein the filter has a plurality of through holes formed around the area of the filter disposed between the filter mounting member and the supply body.

3. The liquid ejecting head according to claim 1, wherein the periphery of the filter is disposed between the filter mounting member and the supply body.

4. The liquid ejecting head according to claim 1, wherein the liquid supply passage includes a plurality of liquid supply passages, the filter comprises a plurality of passage filters, and each liquid supply passage is provided with a passage filter.

5. The liquid ejecting head according to claim 1, wherein the liquid supply passage includes a plurality of liquid supply passages, and the filter is provided continuously so as to cover the plurality of liquid supply passages.

6. A liquid ejecting apparatus comprising the liquid ejecting head according to claim 1.

7. A method for making a liquid ejecting head including a head main body that ejects a liquid supplied from a liquid storage unit, and a supply member provided with a liquid supply passage for supplying the head main body with the liquid, a filter mounting member, a supply body that supplies the filter mounting member with the liquid, and a filter provided between the filter mounting member and the supply body, the method comprising:

disposing the filter between the filter mounting member and the supply body;

forming an outer portion in an integral molding process so that the outer portion continues over a region of the filter disposed between the filter mounting member and the supply member in order to integrate and fix the filter mounting member, the supply body, and the filter in the supply member, and wherein a peripheral portion of at least one of the filter mounting member and the supply body corresponding to the outer portion is provided with a hole that extends from a surface facing the filter to the opposite surface of the peripheral portion, wherein the filter has a plurality of through holes formed around an area of the filter disposed between the filter mounting member and the supply body.

8. A liquid ejecting apparatus comprising:

a liquid storage unit;

a liquid ejecting head comprising:

a head main body capable of ejecting a liquid supplied from the liquid storage unit; and a supply member forming a liquid supply passage for supplying the liquid from the liquid storage unit to the head main body, the supply member comprising a filter mounting member, a supply body that supplies the filter mounting member with the liquid, a filter provided between the filter mounting member and the supply body, and outer portion provided around a region of the filter which is formed by an integral molding process, wherein the outer portion fixes the filter mounting member, the supply body, and the filter in the supply member and wherein the filter is provided so as to extend beyond the area disposed between the filter mounting member and the supply body, the extended area being disposed between portions of the outer portion, wherein a peripheral portion of at least one of the filter mounting member and the supply body corresponding to the outer portion is provided with a hole that extends from a surface facing the filter to the opposite surface of the peripheral portion, wherein a plurality of through holes are provided in the region of the filter disposed between portions of the outer portion.

9. The liquid ejecting apparatus according to claim 8, wherein the filter has a plurality of through holes formed around the area of the filter disposed between the filter mounting member and the supply body.

10. The liquid ejecting apparatus according to claim 8, wherein the periphery of the filter is disposed between the filter mounting member and the supply body.

11. The liquid ejecting apparatus according to claim 8, wherein the liquid supply passage includes a plurality of liquid supply passages, the filter comprises a plurality of passage filters, and each liquid supply passage is provided with a passage filter.

12. The liquid ejecting apparatus according to claim 8, wherein the liquid supply passage includes a plurality of liquid supply passages, and the filter is provided continuously so as to cover the plurality of liquid supply passages.

* * * * *